US005329437A

United States Patent [19]

Briggs

[11] Patent Number: 5,329,437

[45] Date of Patent: Jul. 12, 1994

[54] RETRACTABLE ELECTRIC CANDLE SYSTEM

[76] Inventor: Perry A. Briggs, 1858 Hooksett Rd., Hooksett, N.H. 03106

[21] Appl. No.: 49,073

[22] Filed: Apr. 20, 1993

[51] Int. Cl.[5] ..... F21V 21/34; F21V 35/00

[52] U.S. Cl. ..... 362/393; 362/145; 362/288; 362/403; 362/810

[58] Field of Search ..... 362/125, 145, 285, 288, 362/289, 382, 388, 392, 393, 403, 810

[56] References Cited

U.S. PATENT DOCUMENTS

| | | | |
|---|---|---|---|
| 1,833,721 | 11/1931 | Petersen | 362/393 |
| 2,738,492 | 3/1956 | Arneson et al. | 362/403 |
| 4,272,802 | 6/1981 | Steadman | 362/403 |
| 4,392,191 | 7/1983 | White, Sr. | 362/810 |
| 4,974,134 | 11/1990 | Bourne | 362/289 |

FOREIGN PATENT DOCUMENTS

| | | | |
|---|---|---|---|
| 374007 | 4/1923 | Fed. Rep. of Germany | 362/288 |

*Primary Examiner*—Carl D. Price
*Assistant Examiner*—Alan B. Cariaso
*Attorney, Agent, or Firm*—Frank J. Dykas; Craig M. Korfanta

[57] ABSTRACT

Embodiments of a retractable electric candle system are shown and described, each for installation into a window sill so that the candle rises out of the sill for use and retracts down into the space under the sill for storage. The candle system includes a base for attachment over an aperture drilled in the sill, a candle that slides up and down through the base and the sill, and a tube member into which the candle retracts. When a cover is removed from the base, a spring pops up the candle enough to allow the user to grasp it for lifting. A slot and pin mechanism cooperate to reversibly lock the candle into a raised position when the candle is lifted and rotated about ¼ turn. Electrical contacts, wiring, and electrical tape are positioned to electrify the bulb or other display unit on top of the candle when the candle system is connected to a power source and when the candle is in the raised position. The candle system may include the apparatus for connection to the power source, which may include a clock transformer for reducing the power source voltage to a lower, safer voltage for operation of the candle and for setting times for the automatic turning on and off of the candle.

19 Claims, 6 Drawing Sheets

RETRACTABLE ELECTRIC CANDLE SYSTEM

BACKGROUND OF THE INVENTION

1. Technical Field

This invention relates generally to decorative electric window displays and specifically to electric candles that are set on window sills at holidays.

2. Background Art

Electric candles are often set in window sills of homes and offices for illumination during holiday seasons. These electric candles are reminiscent of old-fashioned wax candles set on window sills for decoration or for symbolic welcoming or lighting of the way.

Typically, electric candles are set on several windows in a home or office building and electric cords trail from the candles, down the wall, and along the floor to a 120 volt electric outlet. The candles are sometimes left unattached to the window sill, or often they are taped down to prevent them from falling over. The electric cords are also often taped down to keep them out of the way and make them less hazardous.

These installation methods can create unsightly and unsafe situations. People and pets can still knock over and break the candles or trip over the electric cords, creating the potential for exposure to 120 volt electricity or for a fire hazard. The appearance and safety issues become even more of a problem when additional wiring is used to reach candles set in more than one window. Another problem is the inconvenience, labor, and storage space required for taking down, storing, and reinstalling the candles for each season of use. Frequently, electric candles are purchased and tried for a season, but seldom used again because of these problems.

What is still needed is a safe, attractive, sturdy, and convenient candle system.

DISCLOSURE OF INVENTION

This invention is a retractable electrical candle system, in which a candle may be retracted for storage into the wall space below a window sill and may be conveniently raised into view for use as desired. The candle is for connection to a light bulb or other electric-powered display unit.

The invention comprises the candle, a candle mounting means, and an electrifying means. The candle mounting means is for attachment to the sill and for holding the candle when retracted below the sill and for holding and locking the candle when raised above the sill. The electrifying means is attached to the candle for supplying power to the electric-powered display unit when the electrifying means is connected to an electric power source and when the candle is raised. When connected to the power source, a transformer may be used to reduce the voltage that is supplied to the candle.

The candle system may include a base for attachment to a window sill that has an aperture drilled into the sill. The base has a hole that is aligned with the aperture, so that the candle may slidably move up or down through the hole to reach the raised or retracted positions, respectively. A lock means may be engaged to hold the candle in the raised position, and a stop means prevents the candle from falling out and away from the base when the candle is in the retracted position. A pop-up means may serve to raise the top end of the candle slightly above the base, when the user wishes to lift the candle, so that the candle may be grasped and lifted all the way to the raised position.

Preferably, the retractable electric candle system also includes a cover, with a plate that is latched over the base hole when the candle is retracted. Preferably, a coiled spring acts as the pop-up means when the cover is removed, pushing up the candle enough for it to be grabbed and lifted.

Apparatus for part of an electrical circuit is included in the invention. The top electrical contact is connected to a bottom electrical contact near the bottom of the candle by way of electrical wiring or conduit. When the candle is in the raised position, the bottom electrical contact touches a base electrical contact that is attached to a base by an attachment means to the base. The base electrical contact is adapted for wiring or other connection to an electric power source. Thus, once hooked to the power source and once the candle is raised and the base and bottom electrical contacts touch, the candle system completes an electrical circuit to provide power to the light bulb or other display unit.

The retractable electric candle system may optionally include the connection means for connecting the base electrical contact to the power source. Preferably, this connection means includes a transformer for reducing the voltage from the power source to 12 volts. This transformer may be of a time-clock variety, which allows the user to set the times that the candle system will automatically be electrified and automatically be shut off.

BEST MODE FOR CARRYING OUT INVENTION

Figure 1:
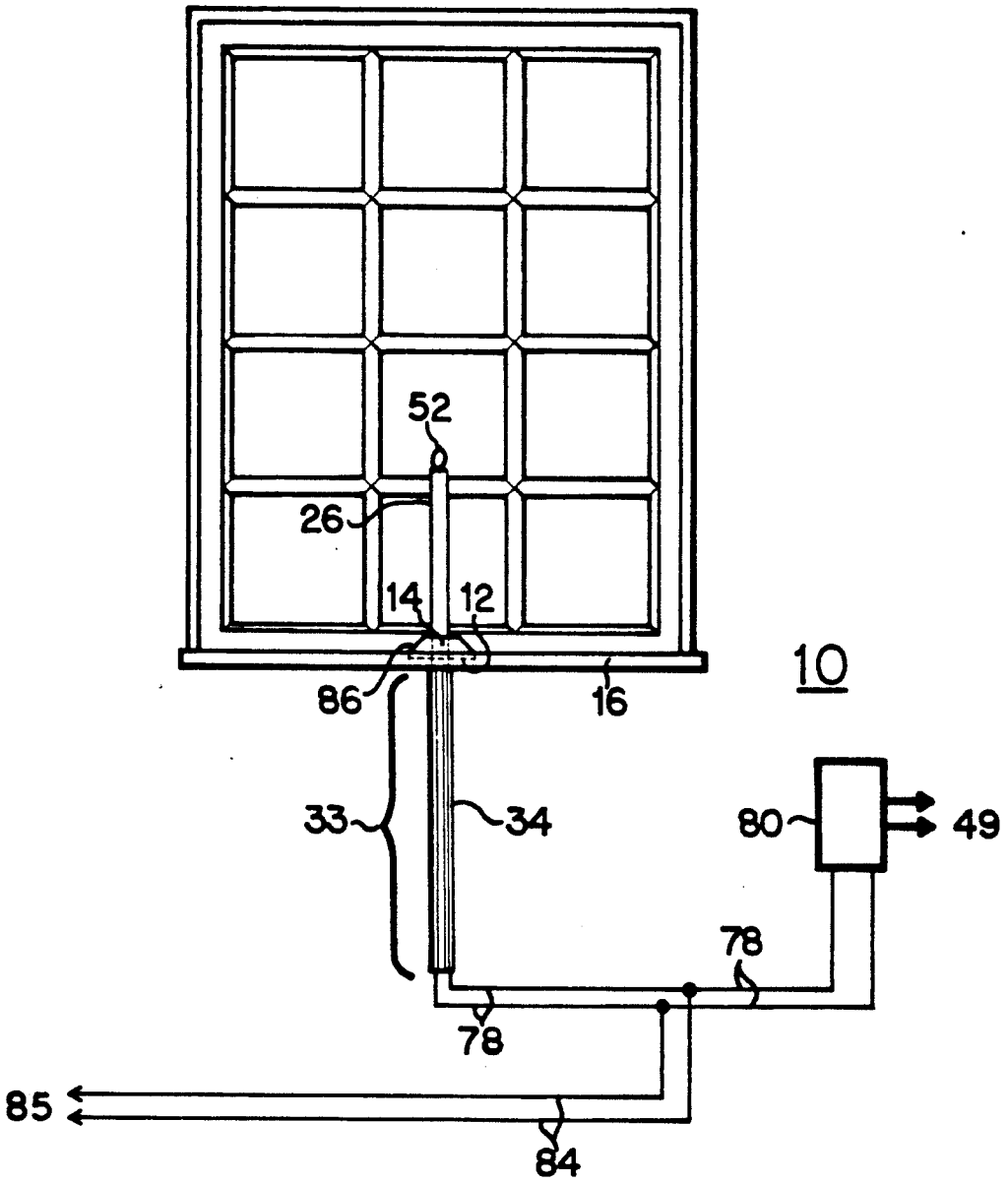
FIG. 1 is a front view of one embodiment of the invented retractable electric candle system installed in a window with the candle raised and including connection means leading to the power source.
Figure 2:
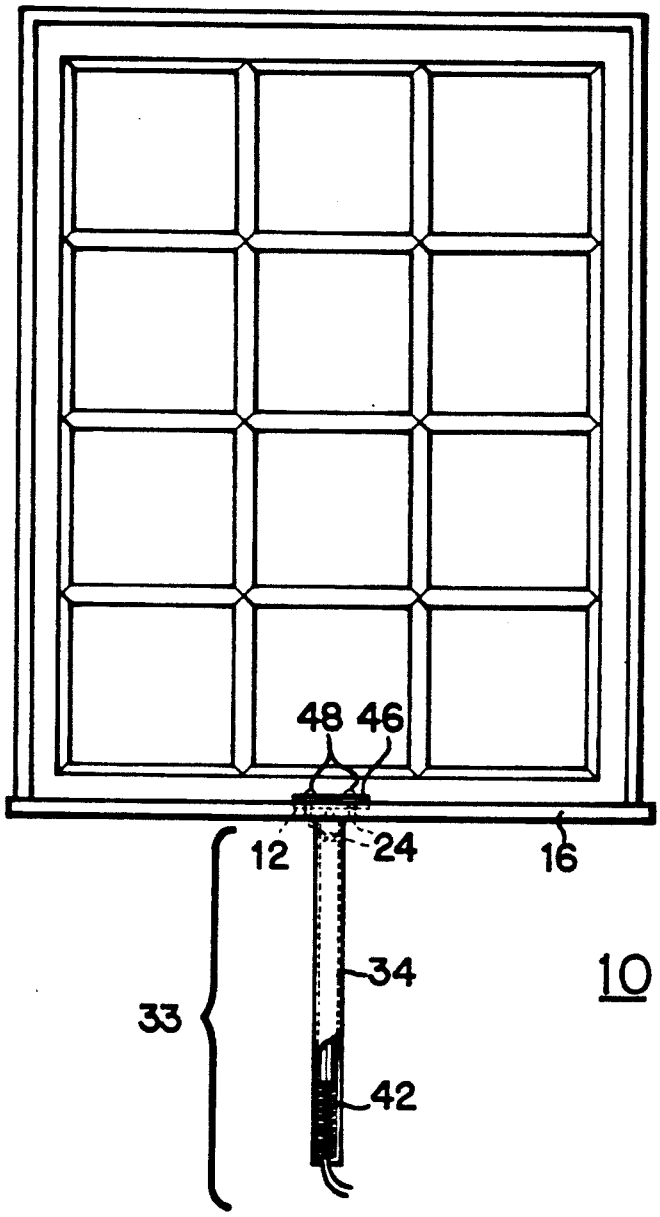
FIG. 2 is a front view of one embodiment of the invention installed in a window and with the candle retracted.
Figure 3:
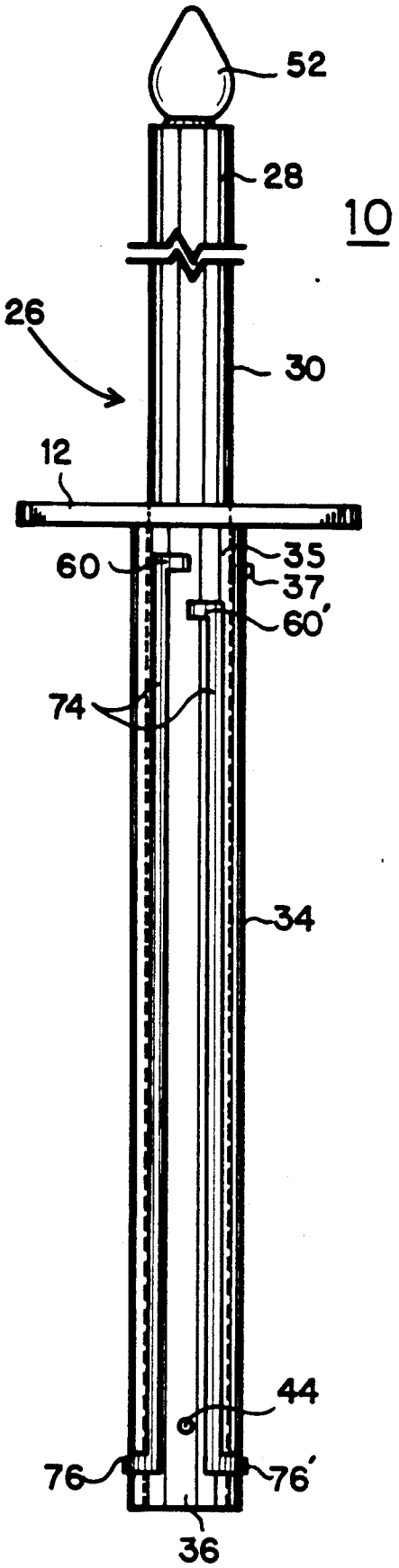
FIG. 3 is a front view of the embodiment of the invention shown in FIG. 2, showing a base, a tube member with tube conductive tape, and a candle locked in the raised position and connected to a light bulb.
Figure 4:
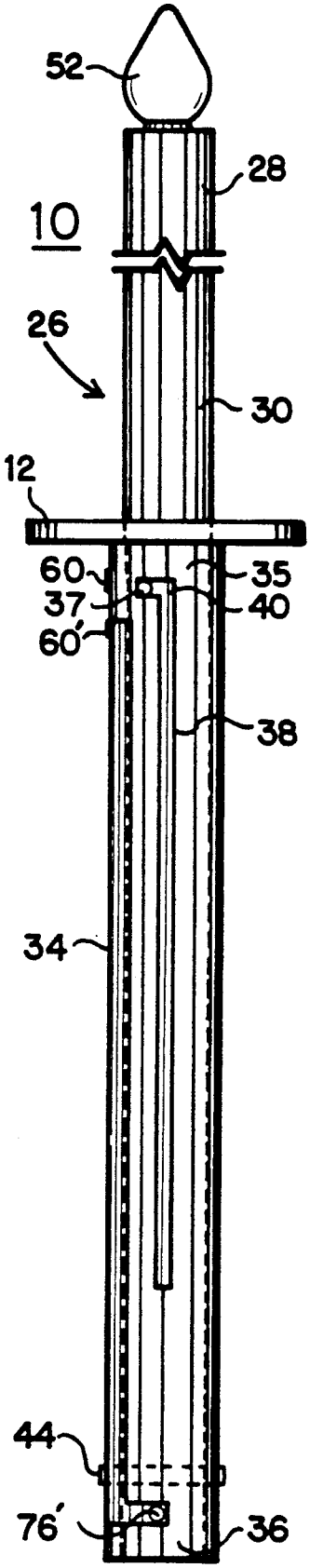
FIG. 4 is a right side view of the embodiment of FIG. 3, showing horizontal and vertical slots, and a lock pin engaged in the horizontal slot to hold the candle in the raised position.
Figure 5:
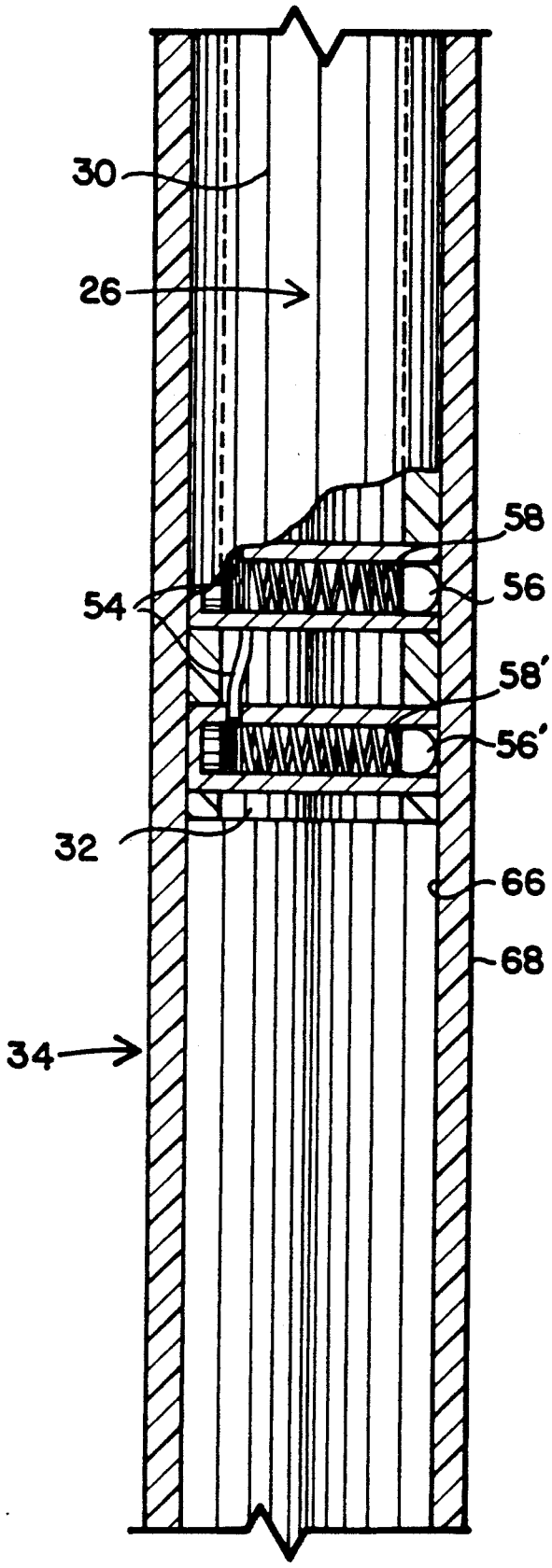
FIG. 5 is a left side view of the embodiment of FIG. 3, with a cross-section of the tube member revealing the bottom end of the candle, and the bottom end cut away to reveal details of one embodiment of the bottom electrical contact touching the base electrical contact.
Figure 6:
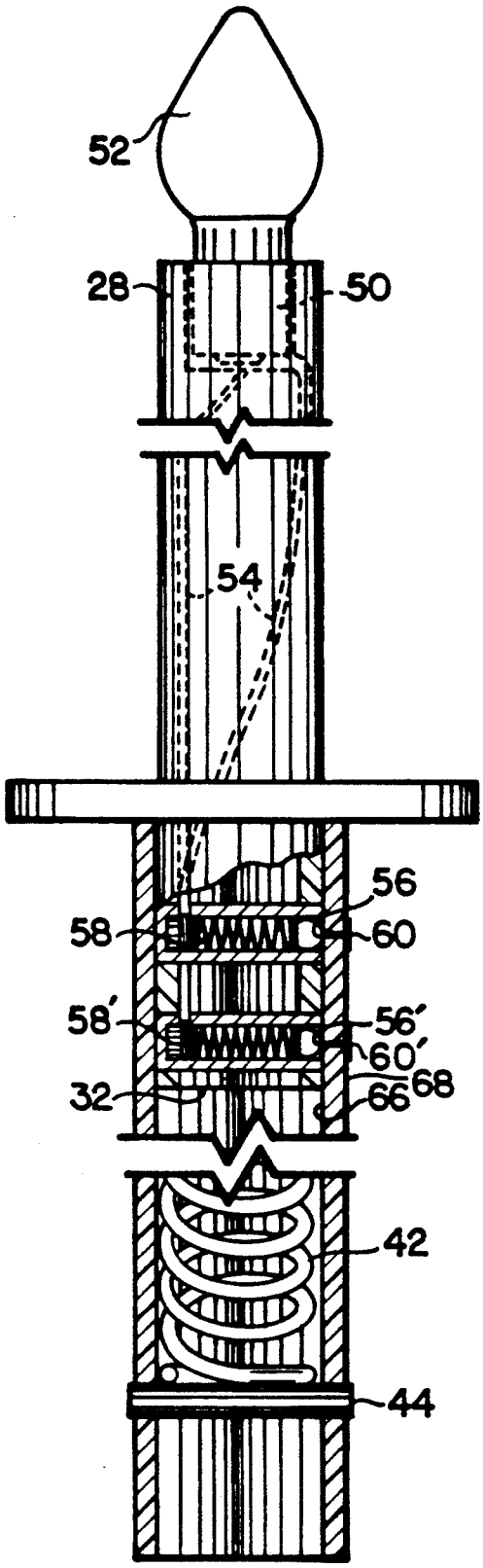
FIG. 6 shows part of the tube member and candle of FIG. 5 with the candle turned to place the bottom electrical contact of FIG. 5 in contact with the interior surface of the tube member.
Figure 7A:
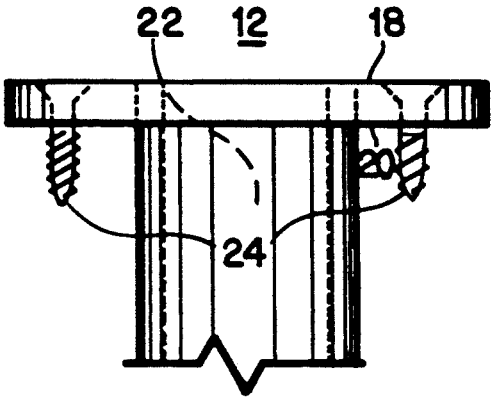
FIG. 7A is a front view of one embodiment of the base and screws for attachment to a window sill.
Figure 7B:
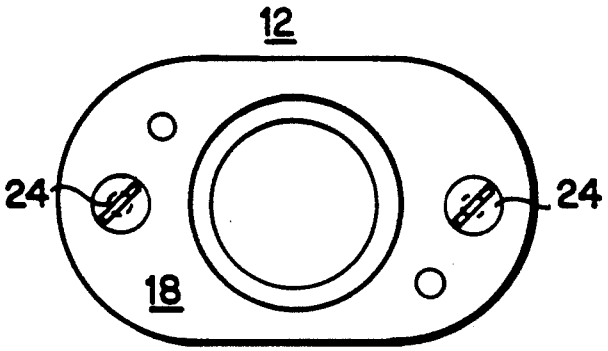
FIG. 7B is a top view of the embodiment of the base and screws from FIG. 7A.

Referring to FIGS. 1–7, there are shown some, but not the only, embodiments of the invented retractable electric candle system 10. The candle system 10 includes a base 12 for placement above an aperture 14 in a window sill 16. The base 12 has a top surface 18, a bottom surface 20, and a hole 22 through the base 12 for alignment with the aperture 14. The base 12 is attached to the sill 16 by an anchor means, which in the preferred embodiment is a set of screws 24. A candle 26 having a top end 28, an elongated body 30, and a bottom end 32 slides up and down through the base hole 22 and the aperture 14 to go into a raised position, as shown in FIG. 1, and a retracted position, as shown in FIG. 2. When in the retracted position, the candle slides into the space 33 under the window sill 16, which is usually the interior space inside a wall in a home or office.

A hollow cylindrical tube member 34 is attached to and extends down from the base 12 into the space 33 below the sill 16. The tube member 34 has a top tube end 35 attached to the base 12 and an opposing bottom tube end 36. The candle 26 slides down into the tube member 34 when being lowered into the retracted position.

The candle system 10 includes a lock means to hold the candle 26 in the raised position when the user desires to display or use the candle. In the preferred embodiment, the lock means comprises a lock pin 37, which extends horizontally from the candle 26 near the bottom end 32, and a vertical slot 38 and horizontal slot 40 in which the lock pin 37 travels. To lock the candle 26 in the raised position, the user lifts the candle 26 and rotates it about ¼ turn clockwise, as viewed when looking down on the top of the candle 26, to swing the lock pin 37 into the horizontal slot 40. To unlock the candle 26, the reverse action is done. The preferred embodiment has a another pin, vertical slot, and horizontal slot on the other side of the candle system 10 about 180 degrees from lock pin 37 and slots 38 and 40.

When unlocked, the candle 26 may be slid down to the retracted position and a stop means prevents the candle 26 from falling down completely out of the base 12 to fall into the wall space. In the preferred embodiment, a coiled spring 42 is held up inside the tube member 34 by a bar 44 and acts as the stop means. When the candle 26 is lowered, the spring 42 contacts the bottom end 32 and is compressed by the candle 26. The spring 42 is also one embodiment of a pop-up means that pushes up the candle 26 so that the top end 28 is slightly above the top surface 18 of the base 12 so that the candle 26 may be grasped and lifted up the rest of the way to the raised position. An alternative pop-up means could be as simple as a flexible tab or thin string attached to the top end 28 of the candle 26 that could be reached when the candle 26 is in the retracted position to pull up the candle 26.

In the preferred embodiment, a cover is placed across the base 12 to cover the hole 22 to prevent anything from falling into the base 12 or tube member 34 and to make attractive the top view of the base 12 and sill 16. The cover may be a plate 46 attached by a latch means, which may be a pair of screws 48. The plate 46 holds the candle 26 down and thereby compresses the spring 42. When the plate 46 is removed, the spring 42 pops the candle 26 up for access.

The candle system 10 includes wiring and contacts that allow it to be electrified once connected to an electric power source 49 and once the candle 26 is in the raised position. The terms "wiring" and "wire" mean traditional electrical wire or any other conductive connecting material used in industry. The candle 26 has a top electrical contact 50 near the top end 28 for receiving and contacting an electric display unit such as a light bulb 52. Typically, the light bulb 52 is left attached to the candle 26 even when the candle 26 is retracted, but if a larger or differently-shaped display unit such as a candelabra is used, the display unit would be removed before retracting the candle 26. Wires 54 connect and extend between the top electrical contact 50 and a bottom electrical contact, which in the preferred embodiment includes two ball bearings 56, 56' biased outward by contact springs 58, 58'. The ball bearings 56, 56' touch the non-conductive tube member 34 when the candle 26 is retracted and touch a base electrical contact when the candle 26 is locked in the raised position. In the preferred embodiment, the base electrical contact is two conductive pins 60, 60' that extend from the interior surface 66 to the exterior surface 68 of the tube member 34 for connection by a safe method to an electrical power source 49. In the preferred embodiment, the tube member 34 acts as an attachment means to attach the base electrical contact to the base, but attachment means of other designs could be used. For example, a ring could extend down from the base 12 to place the two conductive pins 60, 60' in position to contact the bottom electrical contact when the candle 26 is raised. Optionally, the attachment means could also include an extension member that extends down to reach below the candle bottom end 32 when the candle 26 is retracted, of which the tube member 34 may be considered one embodiment.

Optionally, the candle system 10 invention may include the connection means that completes the circuit from the power source 49 to the conductive pins 60, 60' In the preferred embodiment, the connection means includes conductive tape 74 that extends down the exterior surface 68 to reach a screw-down contact near the tube bottom end 36 that is made of two metal washer and bolt assemblies 76, 76'. Wiring 78 is connected to the washer and bolt assemblies 76, 76' and typically runs down through the space 33 under the sill 16 and into the basement or utility walkway of the building. Preferably, a transformer 80 is included in the connection means for reducing the power source voltage below the typical 120 volts. The transformer 80 in the preferred embodiment reduces the voltage to 12 volts, and has 18 AWG/2 conductor wiring 78, and a 12 volt light bulb 52. The low voltage operation of the preferred candle system 10 and putting the connection means in the wall space 33 and the basement or utility walkway make a safe system that lessens the chance of accident or injury.

Optionally, parallel wiring 84 may split off from the connection means to make an electrical circuit with other candle systems 10 in other windows.

Optionally, the transformer 80 may be a time-clock transformer such as a 120 volt/12 volt Malibu TM transformer so that the user may raise the candles 26 and then set the time at which the candles 26 will automatically electrify and the time at which the candles 26 will automatically turn off. Optionally, decorative objects 86 such as a candle holder or figurine may lie on top of the base 12 to attractively cover the base and decorate the candle 26. Such a decorative object 86 would have a hole 88 for removably receiving the candle 26.

The base 12, candle 26, and tube member 34 are made of non-conductive material such as plastic pipe, or may include conductive material as long as the conductive material is properly insulated from the electrical contacts, wiring, and electrical tape for safe operation without short-circuiting.

The preferred method of installation involves drilling the aperture 14 in the window sill 16 slightly larger than the diameter of the tube member 34 and drilling a small hole from the wall space 33 into the basement of utility walkway for the wiring 78. Preferably, a router is used to rout out wood from the window sill 16 in the shape of the base 12 so that the base 12 can sit down slightly into the sill 16 so that the top surface 18 is flush with the sill.

While there is shown and described the present preferred embodiment of the invention, it is to be distinctly understood that this invention is not limited thereto but may be variously embodied to practice within the scope of the following claims.

I claim:

1. A retractable electric candle system for installation through an aperture in a window sill for connection to an electric power source and an electric-powered display unit, the candle system comprising:

a base having a top surface, a bottom surface, and a hole extending through the base from the top surface to the bottom surface, the base for being attached to the sill so that the hole is aligned with the aperture, a candle having a top end, an elongated body, and a bottom end, the candle slidably extending through the base hole and through the window sill aperture for being lifted to a raised position generally above the window sill with the bottom end near the base, and for being lowered to a retracted position generally below the window sill with the top end near the base and with the elongated body and bottom end extending into space below the window sill, a lock means for detachably holding the candle in the raised position, a stop means for preventing the candle from falling out of the base when the candle is in the retracted position, a pop-up means for moving the top end of the candle slightly above the upper surface of the base for allowing the top end to be grasped for lifting the candle to the raised position, a top electrical contact attached to the candle near the top end for connection to and cooperation with the electric-powered display unit, a bottom electrical contact attached to the candle near the bottom end, wire extending between and electrically connecting the top electrical contact and the bottom electrical contact, a base electrical contact for detachably contacting the bottom electrical contact when the candle is the raised position and for connection to the electric power source, so that electric power may be delivered to the base electrical contact, through the bottom electrical contact when the candle is in the raised position, and through the wire to the top electrical contact to power the display unit, and an attachment means for attaching the base electrical contact to the base.

2. A retractable electric candle system as set forth in claim 1, further comprising a cover for covering the hole in the base while the candle is in retracted position, the cover comprising a plate for extending across the hole and a latch means for removably connecting the cover to the base.

3. A retractable electric candle system as set forth in claim 2, wherein the attachment means further comprises an extension member extending down from the base reaching underneath the bottom end of the candle when the candle is in the retracted position and for reaching into the space below the window sill.

4. A retractable electric candle system as set forth in claim 3, wherein the pop-up means comprises a coiled spring between the extension member and the bottom end of the candle, for being compressed by the candle when the candle is in the retracted position and for pushing up the candle when the cover is removed so that the top end reaches above the base.

5. A retractable electric candle system as set forth in claim 1, further comprising a connection means for electrically connecting the base electrical contact to the power source.

6. A retractable electric candle system as set forth in claim 5, wherein the connection means further comprises a transformer for reducing the power source voltage.

7. A retractable electric candle system as set forth in claim 6, wherein the transformer further comprises a clock mechanism for allowing electric power to reach the base electrical contact during a set time period and for interrupting the electric power during a set time period.

8. A retractable electric candle system as set forth in claim 5, further comprising a cover for covering the hole in the base while the candle is in retracted position, the cover comprising a plate for extending across the hole and a latch means for removably connecting the cover to the base.

9. A retractable electric candle system as set forth in claim 8, wherein the attachment means further comprises an extension member extending down from the base for reaching into the space below the window sill and reaching underneath the bottom end of the candle when the candle is in the retracted position.

10. A retractable electric candle system as set forth in claim 9, wherein the pop-up means comprises a coiled spring between the extension member and the bottom end of the candle, for being compressed by the candle when the candle is in the retracted position and for pushing up the candle when the cover is removed so that the top end reaches above the base.

11. A retractable electric candle system as set forth in claim 5, wherein the connection means further comprises parallel electric wiring for connecting the power source to additional, similar retractable electric candle systems.

12. A retractable electric candle system as set forth in claim 5, further comprising a decorative object removably resting above the base and having a hole for removably receiving the elongated body of the candle when the candle is in the raised position.

13. A retractable electric candle system for installation through an aperture in a window sill for connection to an electric power source and an electric-powered display unit, the candle system comprising:

a base having a top surface, a bottom surface, and a hole extending through the base from the top surface to the bottom surface, an anchor means for attaching the base to the window sill so that the base hole is aligned with the window sill aperture, a candle having a top end, an elongated body, and a bottom end, the candle slidably extending through the base hole and through the window sill aperture for being lifted to a raised position generally above the window sill with the bottom end near the base, and for being lowered to a retracted position generally below the window sill with the top end near the base and with the elongated body and bottom end extending into space below the window sill, a lock pin attached to the candle near the bottom end and extending horizontally out from the candle, a tube member defined by a cylindrical wall having an interior surface, an exterior surface, a top tube end, and a bottom tube end, the tube member attached to and extending down from the base for extending into the space below the window sill, the tube member comprising:

a hollow interior for receiving the candle when the candle is in the retracted position, an elongated, vertical slot through the cylindrical wall along the length of the tube member for slidably receiving the lock pin along the length of the vertical slot as the candle is lifted and lowered, a horizontal slot through the cylindrical wall near the top tube end and near the base, the horizontal slot joined to and communicating with the vertical slot for receiving the lock pin when the candle is in the raised position and the candle is turned to swing the lock pin from the vertical slot horizontally into the horizontal slot to lock the candle in the raised position, a cover for covering the hole in the base while the candle is in the retracted position, the cover comprising a plate for extending across the hole and a latch means for removably connecting the cover to the base, a spring inside the tubular member hollow interior, the spring having a bottom spring end held in place near the bottom tube end and a top spring end for removably contacting the bottom end of the candle when the candle is in the retracted position, the spring being compressed when the candle is lowered into the retracted position and the cover is installed across the hole in the base, and the spring extending when the cover is removed to push up the candle to move the top end of the candle slightly above the upper surface of the base to allow the top end to be grasped for lifting the candle to the raised position, a top electrical contact attached to the candle near the top end for connection to and cooperation with the electric-powered display unit, a bottom electrical contact attached to the candle near the bottom end, wire extending between and electrically connecting the top electrical contact and the bottom electrical contact, a base electrical contact, extending from the interior surface of the cylindrical wall near the base, for detachably contacting the bottom electrical contact when the candle is locked in the raised position, a connection means for electrically connecting the base electrical contact to the power source, so that electric power may be delivered to the base electrical contact, through the bottom electrical contact when the candle is in the raised position, and through the wire to the top electrical contact to power the display unit.

14. A retractable electric candle system as set forth in claim 13, wherein the bottom electrical contact comprises two spring-loaded conductive ball bearings biased out against the interior surface of the cylindrical wall when the candle is in the retracted position and biased out against the base electrical contact when the candle is locked in the raised position.

15. A retractable electric candle system as set forth in claim 13, wherein the connection means comprises conductive tape connected to the base electrical contact and extending down along the exterior surface of the tube to the bottom tube end for being wired to the power source.

16. A retractable electric candle system as set forth in claim 13, wherein the connection means further comprises a transformer for reducing the power source voltage.

17. A retractable electric candle system as set forth in claim 16, wherein the transformer further comprises a clock mechanism for allowing electric power to reach the base electrical contact during a set time period and for interrupting the electric power during a set time period.

18. A retractable electric candle system as set forth in claim 13, wherein the connection means further comprises parallel electric wiring connecting the power source to additional, similar retractable electric candle systems.

19. A retractable electric candle system as set forth in claim 13, further comprising a decorative object removably resting above the base and having a hole for removably receiving the elongated body of the candle when the candle is in the raised position.

* * * * *